US008037545B2

(12) United States Patent
McLaughlin

(10) Patent No.: US 8,037,545 B2
(45) Date of Patent: Oct. 18, 2011

(54) ARTICLE AND METHOD INCLUDING A TEMPORARY DECORATION

(75) Inventor: Gerald McLaughlin, Makati (PH)

(73) Assignee: Branders.com, Inc., Mountain View, CA (US)

( * ) Notice: Subject to any disclaimer, the term of this patent is extended or adjusted under 35 U.S.C. 154(b) by 793 days.

(21) Appl. No.: 11/724,974

(22) Filed: Mar. 16, 2007

(65) Prior Publication Data

US 2008/0222779 A1 Sep. 18, 2008

(51) Int. Cl.
*A41D 13/00* (2006.01)
*A42B 1/00* (2006.01)

(52) U.S. Cl. ..... 2/69; 2/209.12

(58) Field of Classification Search ..... 2/69, 246, 2/244; 427/147; 428/195.1, 40, 203, 913; 283/94, 95, 96, 97, 98, 56, 72, 100, 101; 40/618; 8/400
See application file for complete search history.

(56) References Cited

U.S. PATENT DOCUMENTS

| | | | | |
|---|---|---|---|---|
| 2,700,629 | A | 1/1955 | Townsend | |
| 3,399,521 | A | 9/1968 | Georg et al. | |
| 3,607,488 | A | 9/1971 | Colon Yordan et al. | |
| 3,616,357 | A | 10/1971 | Haynes | |
| D254,226 | S | 2/1980 | Morse | |
| 4,269,650 | A | 5/1981 | Arai et al. | |
| 4,285,978 | A | 8/1981 | Quinlivan | |
| 4,444,839 | A | 4/1984 | Dudzik et al. | |
| 5,411,295 | A * | 5/1995 | Bates et al. | 283/81 |
| 5,862,101 | A | 1/1999 | Haas et al. | |
| 5,895,075 | A * | 4/1999 | Edwards | 283/81 |
| 5,992,892 | A | 11/1999 | Schaefer et al. | |
| 6,231,952 | B1 * | 5/2001 | Lipper | 428/195.1 |
| 6,299,967 | B1 | 10/2001 | Collins et al. | |
| 6,602,566 | B2 | 8/2003 | Steenbergen | |
| 6,660,353 | B2 | 12/2003 | Siedl | |
| 6,827,373 | B2 | 12/2004 | Zumberge | |
| 7,333,072 | B2 * | 2/2008 | Yamazaki et al. | 345/5 |
| 2004/0111959 | A1 | 6/2004 | Detchou | |
| 2005/0031810 | A1 | 2/2005 | Fuemmeler | |
| 2005/0102876 | A1 | 5/2005 | Kelly | |
| 2006/0229578 | A1 | 10/2006 | Roe et al. | |
| 2007/0048503 | A1 | 3/2007 | MacDonald et al. | |
| 2009/0100564 | A1 * | 4/2009 | Reydellet et al. | 2/69 |

OTHER PUBLICATIONS

"International Aplication Serial No. PCT/US2008/003460, International Search Report mailed on Jun. 20, 2008", 5 pgs.
"International Aplication Serial No. PCT/US2008/003460, International Search Report mailed on Jun. 20, 2008", 8 pgs.
"Sailrite Enterprises Sailmaking & canvas suppliers Outdoor fabric supplies", [Online]. Retrieved from the Internet. <URL: http:secure.sailrite.com>, Sail Logos Flying Scot Logo Blue (Pair) The adhesive backed DacronÂ® used to produce this class insignia is a high tack, residue free material which does not require sewing,(Accessed May 25, 2006).

* cited by examiner

*Primary Examiner* — Gary L Welch
*Assistant Examiner* — Amber Anderson
(74) *Attorney, Agent, or Firm* — Schwegman, Lundberg & Woessner, P.A.

(57) ABSTRACT

Articles and methods include temporary decorations. Embodiments include temporary decorations applied to promotional articles. Embodiments include a method comprising creating a promotional article including applying a dissolvable decoration to a base item to create the promotional article, the dissolvable decoration being applied in such a manner so as to be removable from the base item by dissolving the dissolvable decoration using a solvent without substantially altering the original physical condition of the base item.

16 Claims, 9 Drawing Sheets

ARTICLE AND METHOD INCLUDING A TEMPORARY DECORATION

FIELD OF THE INVENTION

The invention relates to the field of promotional articles. Particularly, the present invention relates to decorating items with temporary decorations.

BACKGROUND OF THE INVENTION

Promotional items include a variety of items decorated in some manner, for example, items decorated with a logo or some other message. The function of these promotional items may include advertisement or promotion of an event, or of products or services offered by one or more vendors. The promotional items may include hats, such as baseball hats, Tee-shirts, collared type shirts including golf shirts, key-chains, drinking containers such as coffee mugs and tumblers, and watches.

When applying the decorations to these items, often the criteria as to what types of materials and methods to use includes considerations related to the attractiveness and the durability of the final promotional item. For example, with respect to a decoration such as a company logo applied to a shirt, the logo would generally be applied in such a way and using materials and methods so that the logo would not fade or shrink after either wearing or washing of the shirt, and thus become unattractive or unreadable as the decorated shirt is worn and washed. In most instances, the decoration on the promotional item would be intended to have a lifespan of at least that of the lifespan of the item to which the decoration is applied.

Because the decoration applied to a promotional item is intended to last as long as the item itself, the addition of the decoration may detract from the value of the item to the user. For example, a shirt may be decorated with a logo representing a particular employer event, for example a sales conference. The decoration may include text such as "Sales Conference XXXX," wherein the "XXXX" represents a particular year. Once the sales event is over, the user may be deterred from wearing the shirt on later occasions due to the logo, wherein the user no longer wishes to promote or be associated with the decoration as it relates to the particular event or time period. In a further instance, the shirt may indicate a particular status to be associated with the user at a particular point in time, for example "Staff" or "Traffic Control," but wherein the status is not intended to extend beyond a particular event or time period, and therefore the party issuing the shirt may not want the user to retain the indication of the status beyond the designated time period.

Knowing the user will not continue to use the base item after a particular time period, or that the promotional item may be discarded after the particular time period relevant to the promotional item, the base item may be selected to include a low quality or low cost base item. The result may be that the promotional item has limited value to the user receiving the promotional item. In addition, the user, and others exposed to and coming in contact with the promotional item, may view the parties distributing or associated with the promotional item as "cheap" or as providing low quality products and services because of the low quality and low cost of the base item used in creating the promotional item.

SUMMARY OF THE INVENTION

Various embodiments include a method comprising creating a promotional article including applying a dissolvable decoration to a base item to create the promotional article, the dissolvable decoration being applied in such a manner so as to be removable from the base item by dissolving the dissolvable decoration using a solvent without substantially altering an original physical condition of the base item.

Various embodiments include an article comprising a promotional article including a base item and a dissolvable decoration, the dissolvable decoration being removable from the base item using a solvent without altering an original physical condition of the base item.

Various embodiments include an article comprising a base item, a decorative item, a material coupling the decorative item to the base item, wherein the material is dissolvable so that the decorative item may be separated from the base item without substantially altering the physical condition of the base item and without substantially altering an original physical condition of the decorative item.

Various embodiments include an article comprising a promotional article including a base item and a three-dimensional decoration applied to the base item, the three-dimensional decoration including one or more materials that are removable from the base item using a solvent without substantially altering an original physical condition of the base item.

DETAILED DESCRIPTION

Articles and methods including a temporary decoration applied to a promotional article are described herein. In the following description, for purposes of explanation, numerous specific details are set forth in order to provide a thorough understanding of various embodiments of the present invention. It will be evident, however, to one skilled in the art that the present invention may be practiced without these specific details.

For the purposes of the present document, the term "promotional article" shall be taken to include any product or service that is made available by a manufacturer or distributor for use in a promotional manner, and shall be taken to include products to which a custom decoration is or may be applied, and other pre-decorated or undecorated products that are made available for promotional purposes. Promotional articles may include but are not limited to articles intended to promote physical products or services, and may be created to promote activities or events. Promotional articles are not limited to use by entities promoting products, services, activities or events associated with operations for financial profits, and may include products, services, activities, or events promoted by or offered through non-profit organizations.

Figure 1A:
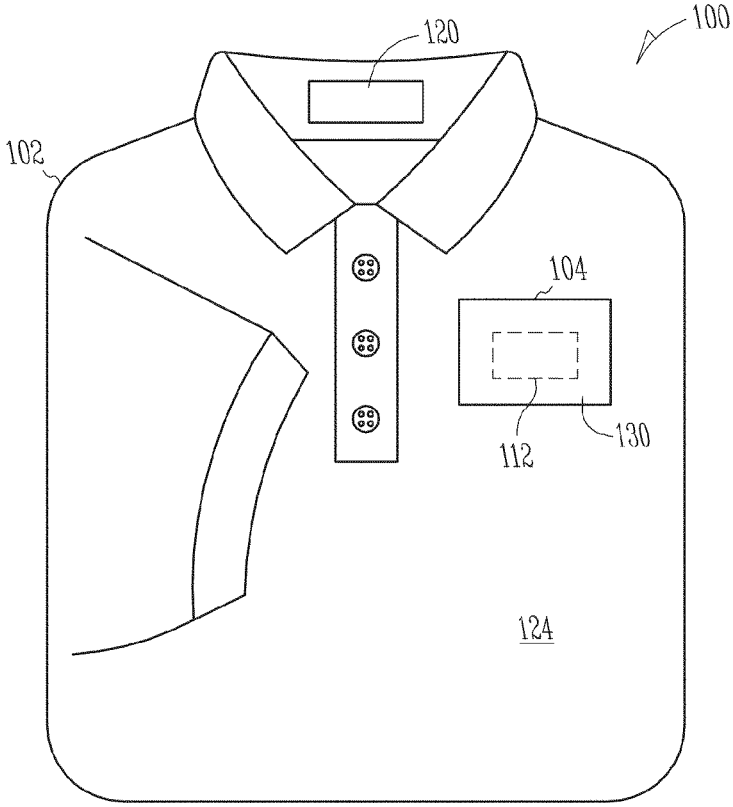
FIG. 1A illustrates an promotional article including a base item and a decoration.

FIG. 1A illustrates a promotional article 100 including a base item 102 and a decoration 104. Base item 102 is not limited to any particular type of item, and may include any item chosen for use in creating a promotional article. In FIG. 1, base item 102 is shown as a shirt. However, in various embodiments, base item 102 may include any item used in creating a promotional article, including but not limited to, any item of clothing, any wearable accessory such as a watch or jewelry, or other items such as drinking mugs or writing instruments, including pens and pencils.

The type of material or materials from which base item 102 is made is not limited to any particular type of material. Base item 102 may be made from any type of material from which at least a portion of base item 102 includes a material to which decoration 104 may be applied. In various embodiments, the base item 102 has an original physical condition. The original physical condition of a base item includes the condition of the base item prior to the application of a decoration, such as decoration 104. The original physical condition of a base item may include, but is not limited to, the color, weight, shape, texture, and dimensions of the base item prior to the application of a decoration to the base item.

Decoration 104 is not limited to being formed from any particular type of material. In various embodiments, decoration 104 is a dissolvable decoration. Dissolvable decorations include any type of material used to form a decoration wherein the decoration is dissolvable at a time following the application of the decoration to a base item. Examples of dissolvable decorations includes decorations formed by applying a washable ink or a washable die to a base item. In various embodiments, the dissolvable decoration includes a decoration formed from embroidery using dissolvable threads.

Various types of washable inks are known. For example, washable inks for use in children's art and crafts are known wherein the inks are designed to be removable by washing from clothing. Other types of specialty inks are known. For example, Domino Printing Sciences plc advertises a specialist water-washable ink - I-006RG - which can be used to form alphanumeric details on a printing plate. Various types of inks or paints that may be set to a permanent state by exposure to heat or ultraviolet light are also known.

Water soluble thread is also known. For example, Collins Water Washable Thread is offered through CreateForLess® as Part Number 20348732, and provides a 3-ply thread that is dissolved by washing.

A dissolvable decoration may be formed using any material that may be applied to a base item and is removable from the base item by dissolving the decoration without substantially altering the original physical condition of the base item. Substantially altering the original physical condition of the base item would include removing one or more portions of the original base item in order to remove the decoration. For example, substantially altering the original physical condition of the base item would include removing a layer of the base item in order to remove the decoration from the base item. The removal of one or more portions of the original base item would include removal of a surface of the original base item through such processes as chemical etching of the promotional article, or through mechanical processes such as sandblasting or other applications of abrasion to a surface of the base items in order to remove the decoration, including such processes as sanding or grinding.

In another example, substantially altering the original physical condition of the original base item in order to remove the decoration would include altering the color of the original base item in order to remove the decoration, for example but not limited to, bleaching the promotional article in order to remove the decoration from the base item, wherein the bleaching also removes or alters the color of the base item as the base item was originally colored before the application of the decoration.

Decoration 104 may be applied to the base item 102 using any processes and equipment appropriate for applying the decoration 104 to the base item 102. Examples of processes include, but are not limited to, silk screening and pad printing.

In not substantially altering the original physical condition of a base item in removing the decoration, the base item would have the same physical appearance and structure as was present in the base item before the decoration was applied.

Decoration 104 is not limited to being applied to any particular location on base item 102. Decoration 104 may be applied to any location of base item 102, including but not limited to a surface 124 of base item 102 that would be visible when base item 102 is worn or used for its intended purpose. In various embodiments, decoration 104 may also be applied to base item 102 in a location such as location 120 as shown in FIG. 1A, being the inside of the collar of a shirt. Location 120 may be a location that is not normally visible when the base item 102 is worn or used for its intended purpose.

In various embodiments, decoration 104 is applied to a substrate 130 which is also dissolvable. Substrate 130 and decoration 104 may include materials that are dissolvable in a solvent that could be used to remove both the substrate and the decoration from base item 102 without substantially altering the original physical condition of the base item. In various embodiments, decoration 104 is applied to substrate 130, and then substrate 130, including decoration 104, is applied to base item 102. Substrate 130 may also be first attached to base item 102, followed by the application of decoration 104 to substrate 130. For example, dissolvable paper, wherein a decoration is applied to the dissolvable paper, and both of which would be removed when exposed to for example water, is known.

Various embodiments of promotional article 100 may include concealed information 112, as shown for example in FIG. 1A. In various embodiments, concealed information 112 includes types of information that are concealed by decoration 104, but that are exposed or are revealed upon removal of the decoration 104 from the base item 102. In various embodiments, the concealed information 112 is separately applied to or included as part of the base item, and is exposed by the removal of the decoration, as explained in further detail below. In various embodiments, the concealed information 112 is part of the applied decoration, for example decoration 104, and is revealed upon the removal of the decoration, as explained in further detail below.

Figure 1B:
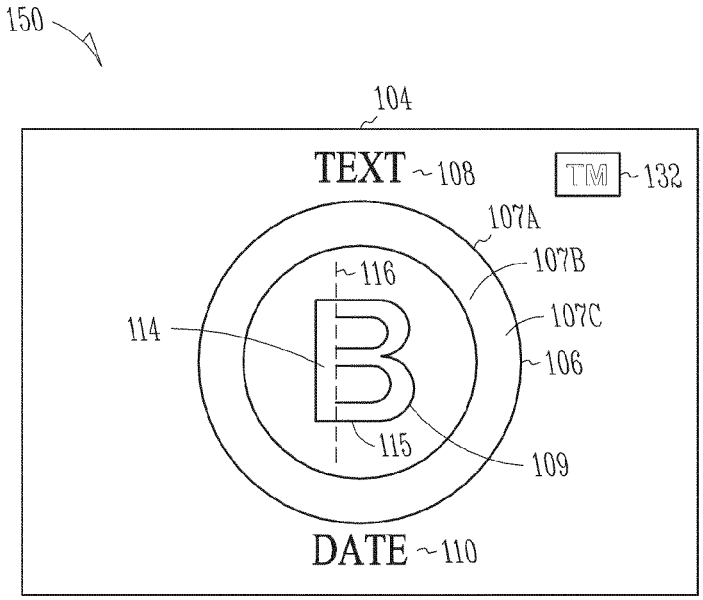
FIG. 1B illustrates a decoration.

FIG. 1B illustrates a decoration 150. Decoration 150 may be for example, but is not limited to, decoration 104 of FIG. 1A. In various embodiments, decoration 150 includes a logo 106. Logo 106 includes two concentric circles 107A and 107B forming a two-dimensional ring 107C. In addition, logo 106 includes a two-dimensional letter 109 representing the letter "B". However, decoration 150 is not limited to any particular subject matter, and need not include a logo. Decoration 150 may include any subject matter, including but not limited to logos, trademarks, or any other types of graphical depictions.

Decoration 150 as shown in FIG. 1B may also include text 108. Text 108 is not limited to any particular text or any particular words. Text 108 is not limited to any particular language, and may include words that are not part of any recognized language. Text 108 may include any type of symbol, including but not limited to letters, numbers, or any other type of graphical symbol. In various embodiments, text 108 is associated with subject matter that has a relevance to a particular time period or to a particular event for which the promotional article of which decoration 150 is a part is intended to promote.

Decoration 150 as shown in FIG. 1B may also include date 110. Date 110 is not limited to any particular date, or to any particular representation of a period in time. In various embodiments, date 110 is associated with a date or a period of time related to a time period or an event for which the promotional article is being created to promote.

In various embodiments, decoration 150 includes both a removable decoration portion and a permanent decoration portion. For example, portion 114 of logo 106 may be a removable decoration portion, and portion 115 may be a permanent decoration portion. A removable decoration portion includes a portion of the decoration that is removed when the process for removing the decoration is applied to the promotional article to which the decoration has been applied. A permanent decoration portion remains as part of the promotional article after the process for removing the decoration has been applied to the promotional article to which the decoration has been applied. In FIG. 1B, portion 114 is a removable decoration portion, separated from portion 115 by line 116. Portion 114 is removable by the application of one or more processes used to remove the decoration from the base item without substantially altering the original physical condition of the base item to which decoration 150 has been applied.

In various embodiments, portion 114 is designed so that when portion 114 is removed, the information represented by logo 106 is changed. In FIG. 1B, when logo 106 includes both portion 114 and portion 115, logo 106 includes a representation of the letter "B." Upon removal of portion 114, the remaining portion 115, which includes the permanent decoration portion, would appear to be a representation of the number "3." By removing the removable decoration portion represented by portion 114 in FIG. 1B, the representation of logo 106 has been changed from the letter "B" to the number "3."

Thus, removing the one or more removable portions of the dissolvable decoration changes the shape of one or more objects depicted by the dissolvable decoration as the dissolvable decoration was originally applied to a base item.

Changes in the representation of decoration 104 by the removal of the removable decoration portion of a decoration is not limited to changing the representation of the decoration from any particular representation to any other particular representation.

Thus, in various embodiments, decoration 150 includes a removable decoration portion and a permanent decoration portion, wherein the design of the decoration includes the combination of the removable decoration portion and the permanent decoration portion so that the combination provides a representation, and the permanent decoration portion without the removable decoration portion provides a representation that is different from the representation of the decoration including both the removable decoration portion and the permanent decoration portion.

In various embodiments, the permanent decoration portion of decoration 150 includes for example logo 106, and the removable decoration portion includes text 108 or date 110, or both text 108 and date 110. The permanent decoration portion and the removable decoration portion of decoration 150 are not limited to any particular parts of the decoration, or to any particular types of information represented by the different portions included in the decoration. The removable and permanent portions of the decoration may be determined by the intended purpose of the promotional article, including the intended purposes both before and after any time period or any event for which the promotional article is created to promote.

In various embodiments, decoration 150 includes a mark 132. Mark 132 may be a registered trademark. Mark 132 is not limited to any particular type of mark, and may include any type of graphical depiction. Mark 132 may be made from the same dissolvable material from which the decoration 150 is made. Mark 132 may be promoted as an indication that the decoration 150 is a temporary or dissolvable decoration, so as to indicate to the user that the decoration is temporary. The indication of the decoration as temporary may encourage the user to receive or purchase the promotional article, knowing that the mark indicates a decoration that can be later removed from the base item without substantially altering the original physical condition of the base item.

Figure 2A:
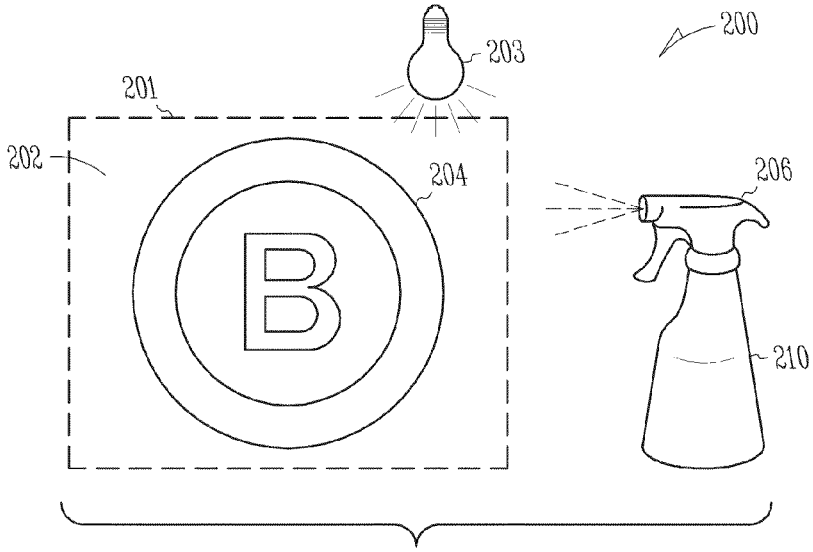
FIGS. 2A, 2B, and 2C illustrate a process wherein a dissolvable decoration is removed from a promotional article.
Figure 2B:
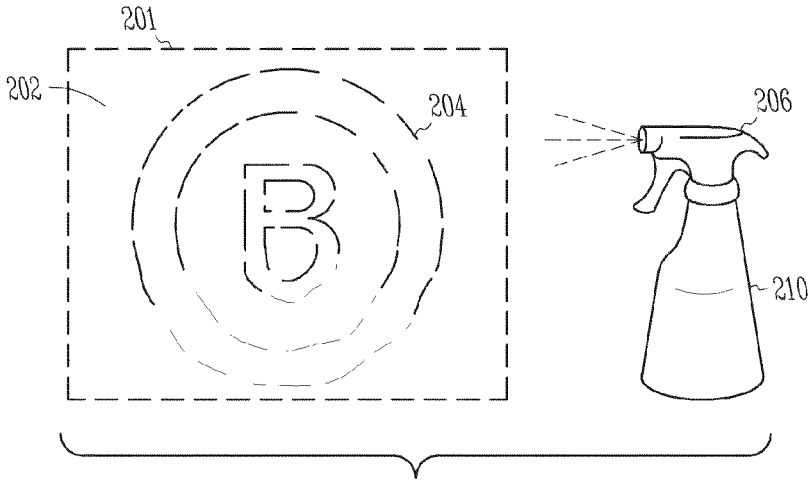
Figure 2C:
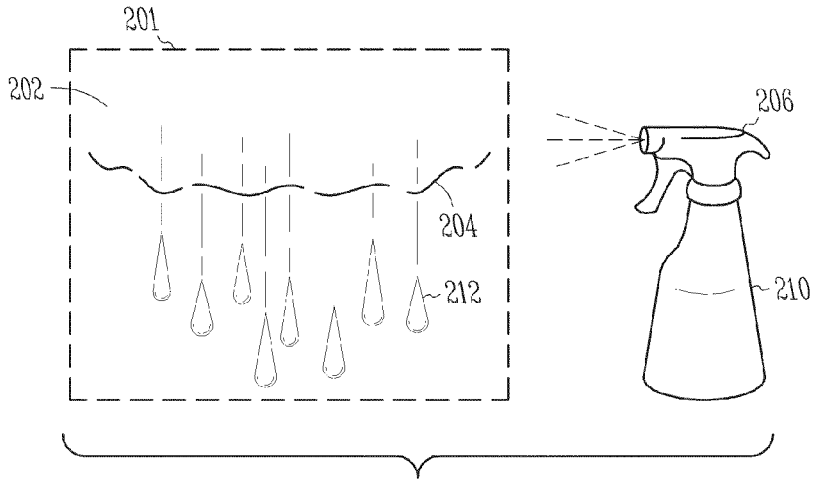

FIGS. 2A, 2B, and 2C illustrate a process 200 wherein a dissolvable decoration 204 is removed from a promotional article 201. FIG. 2A shows a promotional article 201 including a base item 202 to which a dissolvable decoration 204 has been applied. A solvent applicator 206 includes a solvent 210. Solvent applicator 206 is illustrated as a spray bottle. However, embodiments are not limited to any particular solvent applicator. Solvent applicator 206 is not limited to any particular device, and may include any device used to bring a solvent into contact with the decoration applied to the base item including, but not limited to, devices to directly contact the decoration such as a sponge or a brush, devices used to spray liquids such as spray bottles or a hose, and machines such as but not limited to a clothes washing machine or a dishwasher. Solvent 210 may also be applied to promotional article 201 without the use of a solvent applicator such as solvent applicator 206 by simply applying solvent 210 by hand. For example, a solvent such as water or a soap and water solution may be brought into contact with dissolvable decoration 204 by applying the solvent to a user's hand, and then bringing the hand into contact with dissolvable decoration 204. In various embodiments, the user may selectively apply the solvent to various portions of the decoration, and thereby selectively remove only portions of the dissolvable decoration 204.

Solvent 210 is not limited to any particular solvent. Solvent 210 may be any solvent capable of removing a dissolvable decoration from a promotional article. In various embodiments, solvent 210 is water. In various embodiments, solvent 210 is a solution of soap and water. In various embodiments, solvent 210 is a liquid including alcohol, or a liquid including mineral spirits, or a liquid including acetone. In various embodiments, solvent 210 is provided as part of a vapor, wherein for example solvent 210 is provided as part of an aerosol spray. In various embodiments, solvent 210 is supplied with each of the promotional articles 201, the supplied solvent being a solvent that may be used to dissolve dissolvable decoration 204 from base item 202 without substantially altering the original physical condition of the base item 202.

In various embodiments, dissolvable decoration 204 may be exposed to some form of treatment prior to the application of solvent 210. For example, dissolvable decoration 204 may be exposed to a pretreatment, such as but not limited to, light or heat, represented by source 203 in FIG. 2A. Source 203 is not limited to providing any particular type of pretreatment, and may include any type of pretreatment that would make dissolvable decoration 204 removable through the application of solvent 210 after dissolvable decoration 204 is exposed to the pretreatment provided by source 203. In various embodiments, the application of the pretreatment, such as but not limited to the light or heat provided by source 203, removes the decoration from the base item without the need to apply solvent 210. For example, dissolvable decoration 204 may be made from a material that, when exposed to the pretreatment from source 203, is removed from base item 202 through one or more processes such as evaporation or a change to the chemical structure or composition of the material forming dissolvable decoration 204. In various embodiments, source 203 is some naturally occurring source, for example sunlight or air. In various embodiments, promotional article 201 is packaged or folded in a particular manner so as to protect the promotional article 201 from these naturally occurring sources, but is later exposed to these naturally occurring sources when the promotional article is removed from the packaging or is unfolded.

As illustrated in FIG. 2A, solvent 210 may be sprayed from solvent applicator 206 onto the base item 202 in the area including the dissolvable decoration 204. FIG. 2B illustrates that dissolvable decoration 204 is being dissolved by solvent 210, and begins to be removed from the base item 202. Because the material used to form dissolvable decoration 204 is dissolvable in solvent 210, and base item 202 is not soluble in solvent 210, the application of solvent 210 dissolves, and thus proceeds to remove, dissolvable decoration 204 from base item 202 without substantially altering the original physical condition of base item 202, as illustrated in FIG. 2B.

FIG. 2C illustrates the final dissolving of dissolvable decoration 204 using solvent 210. As solvent 210 dissolves dissolvable decoration 204, a solution 212 is formed that includes the dissolved material used to make dissolvable decoration 204 and the solvent 210. In various embodiments, the solution 212 may be completely rinsed from the base item 202 by continuing to apply solvent 210 to the base item 202 until the decoration is dissolved and rinsed from the base item. In various embodiments, solution 212 may be rinsed from the base item 202 using a second solvent, such as but not limited to, water or a water and soap solution.

Figure 3A:
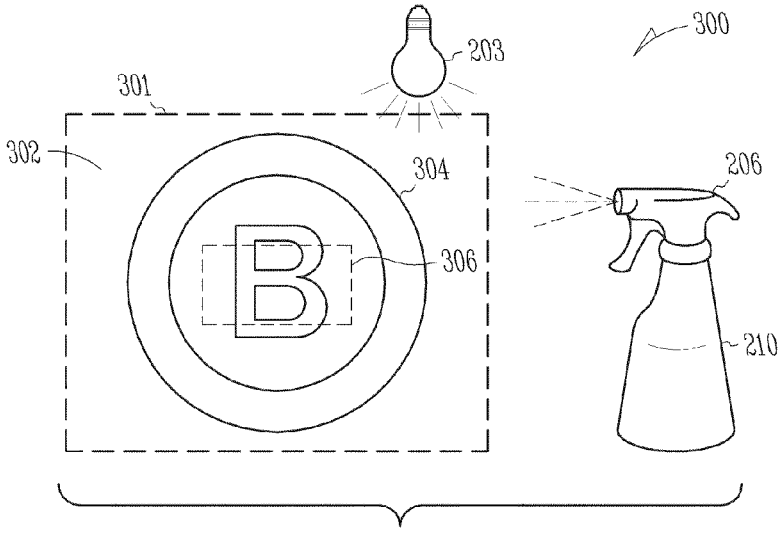
FIGS. 3A, 3B, and 3C illustrate a process wherein a dissolvable decoration is removed from a promotional article in order to reveal concealed information.
Figure 3B:
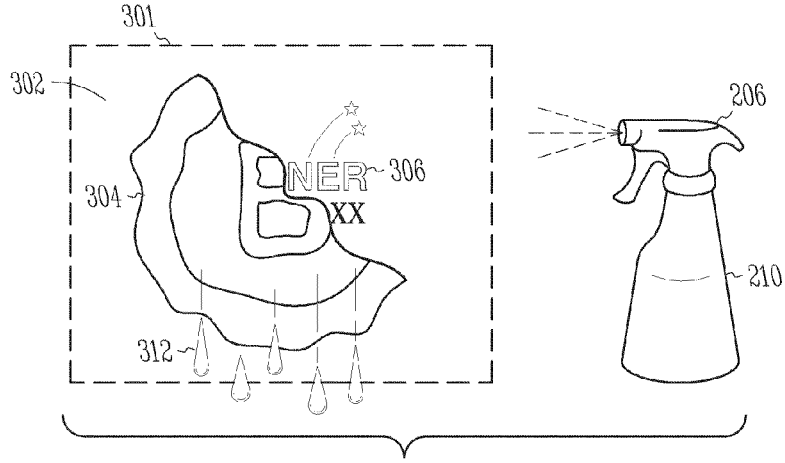
Figure 3C:
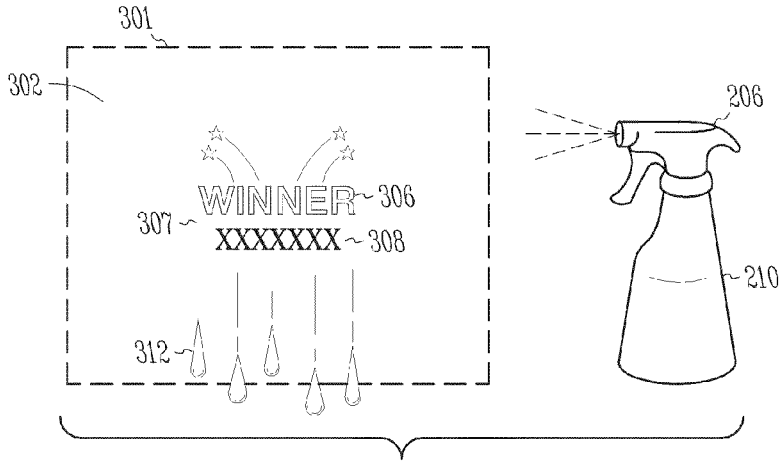

FIGS. 3A, 3B, and 3C illustrate a process 300 wherein a dissolvable decoration 304 is removed from a promotional article 301 including base item 302 in order to reveal concealed information 306. In FIG. 3A, base item 302 includes concealed information 306, which is concealed by dissolvable decoration 304. In various embodiments, such as the embodiments as described above with respect to FIGS. 2A, 2B, and 2C, solvent applicator 206 is used to apply solvent 210 to dissolvable decoration 304, wherein dissolvable decoration 304 is dissolvable in solvent 210. As in FIGS. 2A, 2B, and 2C, the decoration in FIGS. 3A, 3B, and 3C may be pretreated using source 203 to either actually remove, or to pretreat for removal, dissolvable decoration 304. In various embodiments, removal of dissolvable decoration 304 is begun by application of solvent 210 to dissolvable decoration 304. As dissolvable decoration 304 is dissolved, and the solution 312 including the dissolved dissolvable decoration 304 and the solvent 210 is formed, the concealed information 306 begins to be visible, as illustrated in FIG. 3B. As shown in FIG. 3C, concealed information 306 is fully visible upon removal of dissolvable decoration 304.

Concealed information 306 is shown in FIG. 3C as the phrase "WINNER" 307 including other graphics such as lines and stars, used to embellish the phrase "WINNER" 307. In various embodiments, concealed information 306 includes graphics 308. Graphics 308 is not limited to any particular type of graphics, and may include text including numbers. In various embodiment, graphics 308 represents a code used as an entry into a contest or other promotional event, as further discussed below. In various embodiments, graphics 308 may include a machine readable graphical representation such as bar code or a dot matrix array, which is readable by a scanner or other device.

However, concealed information 306 is not limited to any particular type of information. In various embodiments, concealed information 306 may include one or more logos, or any other types of graphic depictions. In addition, concealed information 306 may include text including letters or numbers or other graphic symbols. In various embodiments, concealed information 306 relates to a contest or other promotional activity, wherein the concealed information provides further information related to a contest or other promotional activity. For example, the concealed information may indicate that a prize has been won. In another example, the concealed information may include a code or an entry number that a user may need to determine if a prize has been won, or for entry into a contest or other promotional event.

In various embodiments, the decoration in FIGS. 2A, 2B, and 2C or in FIGS. 3A, 3B, and 3C may be formed of a material that is dissolvable in solvent 210, such as dissolvable thread embroidered onto the base items. The dissolvable thread may be later removed from the base item using solvent 210 as shown in FIGS. 2A, 2B, and 2C and in FIGS. 3A, 3B, and 3C.

Figure 4A:
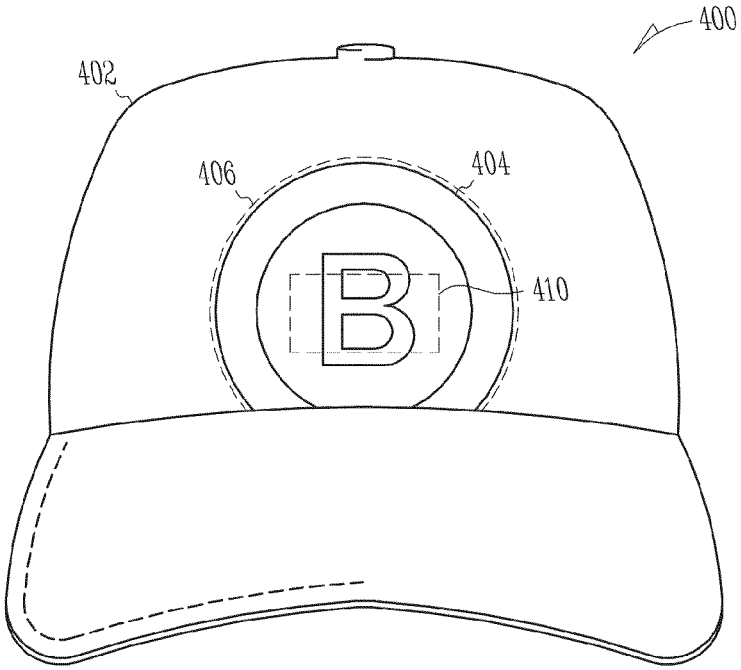
FIG. 4A illustrates a promotional article including a base item and a decorative item.

FIG. 4A illustrates a promotional article 400 including base item 402 and a decorative item 404. Base item 402 is shown as a baseball hat, although embodiments are not limited to any particular type of base item. Decorative item 404 is shown as a patch, for example a cloth patch, although embodiments are not limited to any particular type of decorative item.

In various embodiments, decorative item 404 is coupled to base item 402 using a dissolvable material, such as a dissolvable adhesive. For example, decorative item 404 is coupled to base item 402 using a dissolvable material 406 so that the decorative item 404 may be separated from the base item without substantially altering the original physical condition of the base item 402, and without substantially altering the original physical condition of the decorative item 404. The original physical condition of a decorative item includes the condition of the decorative item prior to the application of the decorative item to a base item. The original physical condition of the decorative item may include, but is not limited to, the color, weight, shape, texture, and dimensions of the decorative item prior to the application of the decorative item to a base item.

In various embodiments, separating the decorative item 404 from the base item 402 includes dissolving an adhesive used to couple decorative item 404 to the base item 402, wherein the solvent used to dissolve the adhesive does not dissolve the decorative item 404 or the base item 402, and does not substantially alter the original physical condition of the decorative item 404 or the original physical condition of the base item, Any puncture holes produced in the base item 402 or in the decorative item 404 in the process of applying decorative item 404 using, for example a dissolvable thread, wherein the puncture holes are not substantially larger than the cross-sectional area of the dissolvable thread, would not constitute substantially altering the original physical condition of the base item or the decorative item. In contrast, removing a portion of the base item that was originally part of the base item before the decoration was applied in order to remove the decorative item would constitute substantially altering the original physical condition of the base item.

Dissolvable adhesives, for example "Stabilizers" are known in the art and craft industry, and may be suitable for use in various embodiments of the present invention. Product names associated with such stabilizers include "Aqua-Magic" and "Aqua-Bond", which both are dissolvable stabilizers.

In various embodiments, dissolvable material 406 includes dissolvable threads. Dissolvable threads may include threads made of any material that may be dissolved by a solvent that may be applied to promotional article 400 and that will dissolve dissolvable material 406, but will not substantially alter the original physical condition of decorative item 404 and the original physical condition of base item 402.

Decorative item 404 may be removed by any process of applying a solvent of dissolvable material 406 to the promotional article 400. Examples of processes for removal of decorative item 404 from base item 402 may include, but are not limited to, the processes as depicted in FIGS. 2A, 2B, and 2C and FIGS. 3A, 3B, and 3C as described above. In various embodiments, promotional article 400 may be placed into a solvent, including but not limited to, submersing promotional article 400 into the solvent used for dissolving dissolvable material 406. In various embodiments, promotional article 400 may placed into a machine, for example a clothes washer, in order to perform the removal of decorative item 404 from base item 402 by operating the clothes washer. Operation of the clothes washer may include exposing the promotional article 400 to water alone, or exposing the promotional article 400 to water and other chemicals such as a commercially available laundry detergent.

Once removed, both base item 402 and decorative item 404 may be used for various purposes, either in combination or separately from one another.

In various embodiments, the base item 402 includes concealed information 410 that is revealed upon removal of the decorative item 404 from base item 402. Concealed information 410 is not limited to any particular type of information, and may include text, logos, or any other types of graphical depictions.

Figure 4B:
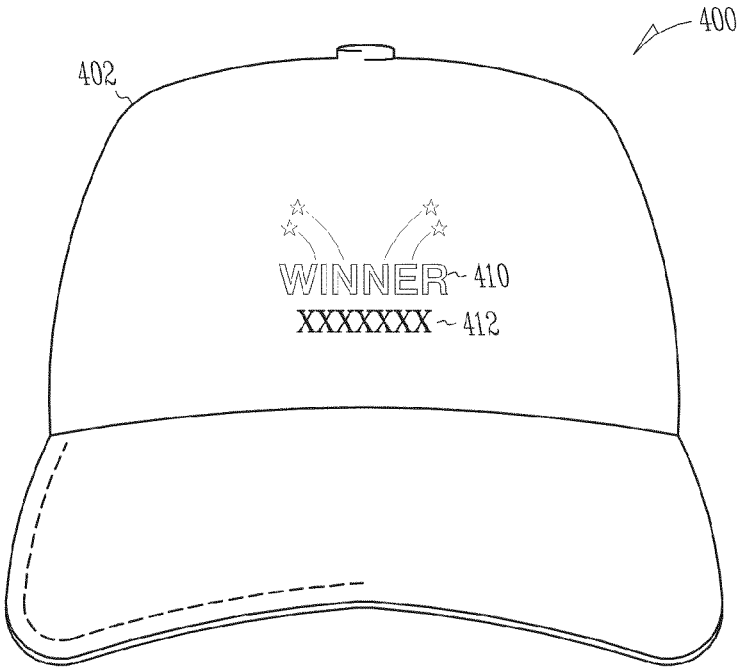
FIG. 4B illustrates a promotional article including a base item and concealed information.

FIG. 4B illustrates a promotional article 400 including base item 402 and concealed information 410 after the removal of decorative item 404. With the removal of decorative item 404, concealed information 410 is revealed, and is visible when viewing promotional article 400. In various embodiments, concealed information 410 includes information 412. In various embodiments, information 412 is related to a contest or other promotional activity, as described above.

Figure 4C:
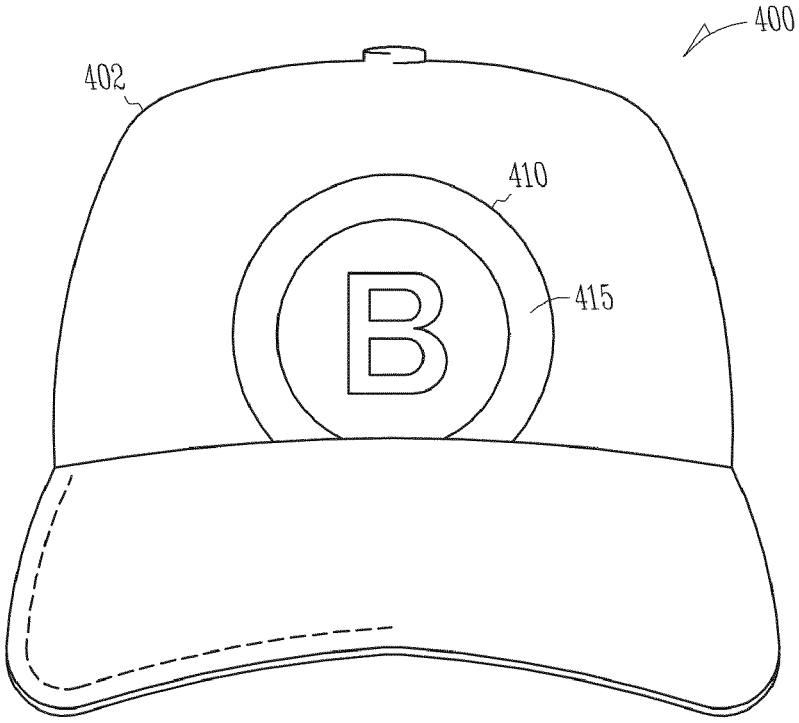
FIG. 4C illustrates a promotional article including a base item and concealed information.

FIG. 4C illustrates a promotional article 400 including base item 402 and concealed information 410 after the removal of decorative item 404. In various embodiments, the concealed information 410 that is revealed after removal of decorative item 404 is a replica 415 of the image present on the decorative item 404, wherein removal of the decorative item 404 leaves the concealed information 410 giving the base item 402 the same appearance with regards to a decoration as was provided by the decorative item 404 as applied to base item 402. In various embodiments, replica 415 may be of a different size, a different scale, or a different color as was provided by the decorative item 404. Replica 415 need not be an exact duplication of the depiction provided by decorative item 404. For example, replica 415 may represent a modern version of a trademark used by a company or a logo used by a sports team, wherein replica 415 was initially concealed by a decorative item 404 which depicted a historical version of the company's trademark or of the team's logo.

Figure 4D:
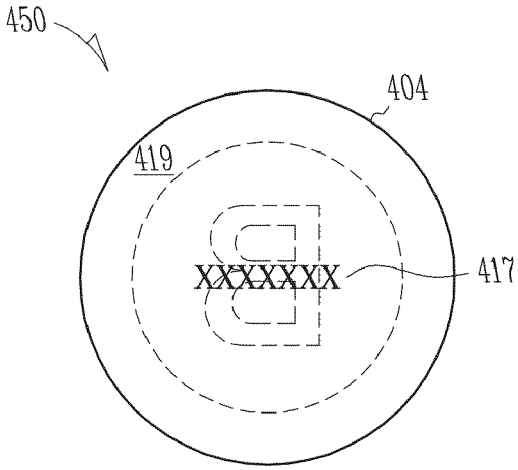
FIG. 4D illustrates a decorative item having a back surface including concealed information.

FIG. 4D illustrates view 450 of decorative item 404 having a back surface 419. In various embodiments, decorative item 404 may include concealed information 417, such as a code or indication that a prize has been won, on the back surface 419 of decorative item 404. In various embodiments, back surface 419 is not visible when decorative item 404 is coupled to base item 402, but is visible, and reveals the concealed information 417 included on back surface 419, after decorative item 404 is removed from base item 402.

Figure 4E:
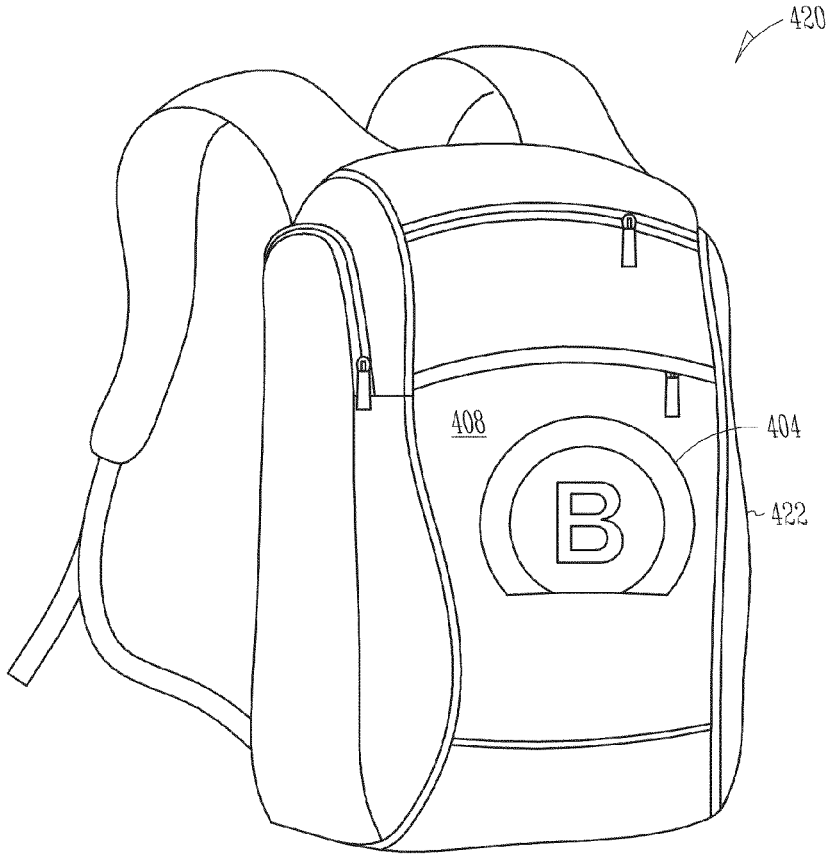
FIG. 4E illustrates a combination of an item and a decorative item following removal of the decorative item from a base item.

FIG. 4E illustrates a combination 420 of item 422 and decorative item 404 following removal of decorative item 404 from base item 402. In various embodiments, decorative item 404 may be combined with one or more other items other than base item 402 following the removal of decorative item 404 from base item 402. Item 422 is shown as a bag including a surface 408. However, item 422 is not limited to any particular type of item. Decorative item 404 is the decorative item as shown in FIG. 4A that was previously applied to base item 402, and has been removed from base item 402. Once removed from base item 402, decorative item 404 is coupled to surface 408 of item 422, and thus provides a decoration for item 422. Decorative item 404 may be coupled to item 422 in any manner, and is not limited to being coupled to item 422 in a manner that allows decorative item 404 to later be separated from item 422 without substantially altering the original physical condition of decorative item 404 or the original physical condition of item 422.

It is not necessary to combine decorative item 404 with any other item or items after decorative item 404 is removed from a base item to which decorative item 404 was previously attached. For example, decorative item 404 may include a cloth patch that is used as decorative coaster after it has been removed from a base item to which it was previously attached. In various embodiments, decorative item 404 may be used for example as a ticket or a voucher in order to gain access to an event, or as an entry device allowing a user to gain entry into a contest, or to claim prizes using the decorative item.

Figure 5A:
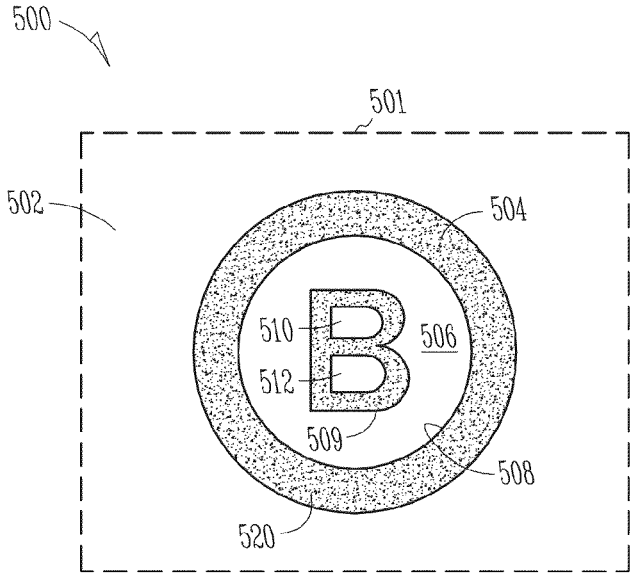
FIG. 5A illustrates a view of a promotional article including a base item and a decoration.
Figure 5B:
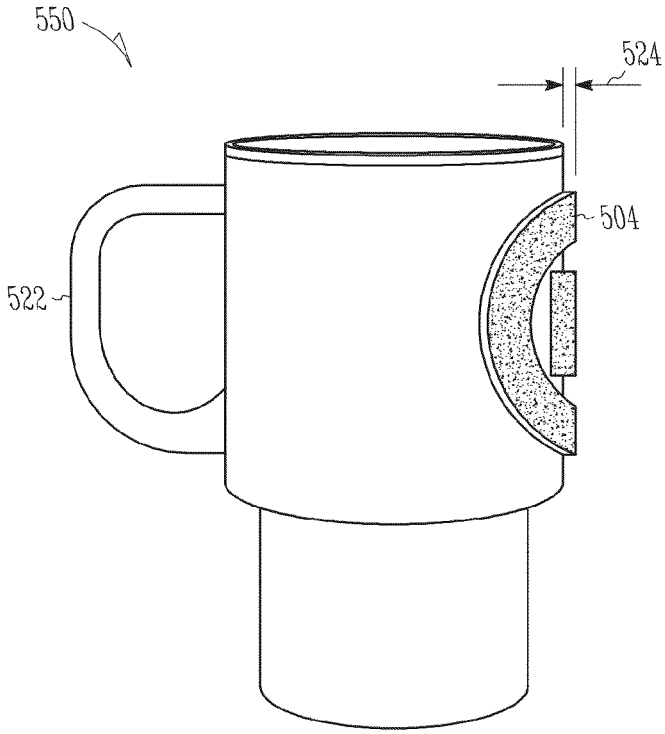
FIG. 5B illustrates a side view of a decoration as applied to a base item.

FIG. 5A illustrates a view 500 of a promotional article 501 including a base item 502 and a decoration 504. Decoration 504 is a three-dimensional decoration made from one or more materials that are removable from the base item 502 without substantially altering the original physical conditional of the base item 502. In various embodiments, decoration 504 has a thickness 524 as shown in FIG. 5B. Decoration 504 is not limited to being made from any particular material. In various embodiments, decoration 504 includes a solid material embedded in a dissolvable material. For example, embodiments of decoration 504 may include sand embedded in a dissolvable material, such as a dissolvable adhesive. Decoration 504 would be applied to base item 502 so that the embedded material, for example the sand, would be exposed and visible on a surface 520 when viewing promotional article 500.

In various embodiments, an adhesive—for example Superglue®—may be used to form the three-dimensional decoration. In various embodiments, other material, for example sand, may be added to or embedded in the adhesive in order to provide a texture or a visual appearance to the three-dimensional decoration. The adhesive may be washed for example in water without altering the appearance of three-dimensional decoration. The three-dimensional decoration, formed for example of Superglue®, may also be removed from the base product using a solvent, for example acetone, which dissolves the Superglue® and causes any other material embedded in the adhesive to be removed from the base item.

Decoration 504 is shown in FIG. 5A as a logo. However, decoration 504 is not limited to any particular type of decoration. Decoration 504 may include any graphical representation, and may include text. In various embodiments, decoration 504 may include areas, for example area 508 and area 509, that include material embedded in a dissolvable material. In various embodiments, decoration 504 may include areas within decoration 504, such as area 510 and area 512, that do not include the material embedded in a dissoluble material. In various embodiments, areas 510 and 512 include the dissolvable material, but not the embedded material used to make decoration 504. In various embodiments, areas 510 and 512 are a surface of the base item 502 not covered over by a portion of decoration 504. In various embodiments, decoration 504 may be shaped so that decoration 504 provides a border surrounding an area 506 of the base item 502 so that an area, such as area 510, forms a letter, a number, or another graphical depiction, such as a logo or a trademark. By forming decoration 504 as a border, the letter, number, or graphical depictions may thereby appear as an incused area, or as an engraved area, on base item 502.

FIG. 5B illustrates a side view 550 of decoration 504 as applied to base item 522. Base item 522 is shown in FIG. 5B as a drinking mug. However, base item 522 is not limited to any particular type of item. Base item 522 may include any items to which a three-dimensional dissolvable decoration may be applied.

As illustrated in FIG. 5B, decoration 504 has a thickness 524. Thickness 524 is not limited to any particular thickness. Thickness 524 is any thickness necessary to apply decoration 504 to base item 522 and which provides the desired effect after the application of the decoration 504. The desired effect may include, but is not limited to, providing a visual effect of a texture, or a visual effect having the appearance of a sandblasted surface, or of a frosted surface, or of a surface that has been engraved.

In various embodiments, decoration 504 is removed from base item 522 by applying a solvent to decoration 504. The applied solvent is not limited to any particular type of solvent, and may include any solvent capable of dissolving the dissolvable material included in decoration 504 without substantially altering the original physical condition of the base item 522. The applied solvent does not necessarily have to be capable of dissolving the material included in decoration 504 that is embedded in the dissolvable material included in decoration 504. In the process of dissolving the dissolvable material included in decoration 504, the material embedded in the dissolvable material will be removed from the base item, for example base item 522, as the dissolvable material is dissolved. Therefore, the entire decoration 504, including the embedded material, will be removed from the base item 522 when the dissolvable material included in the decoration is dissolved.

Figure 6A:
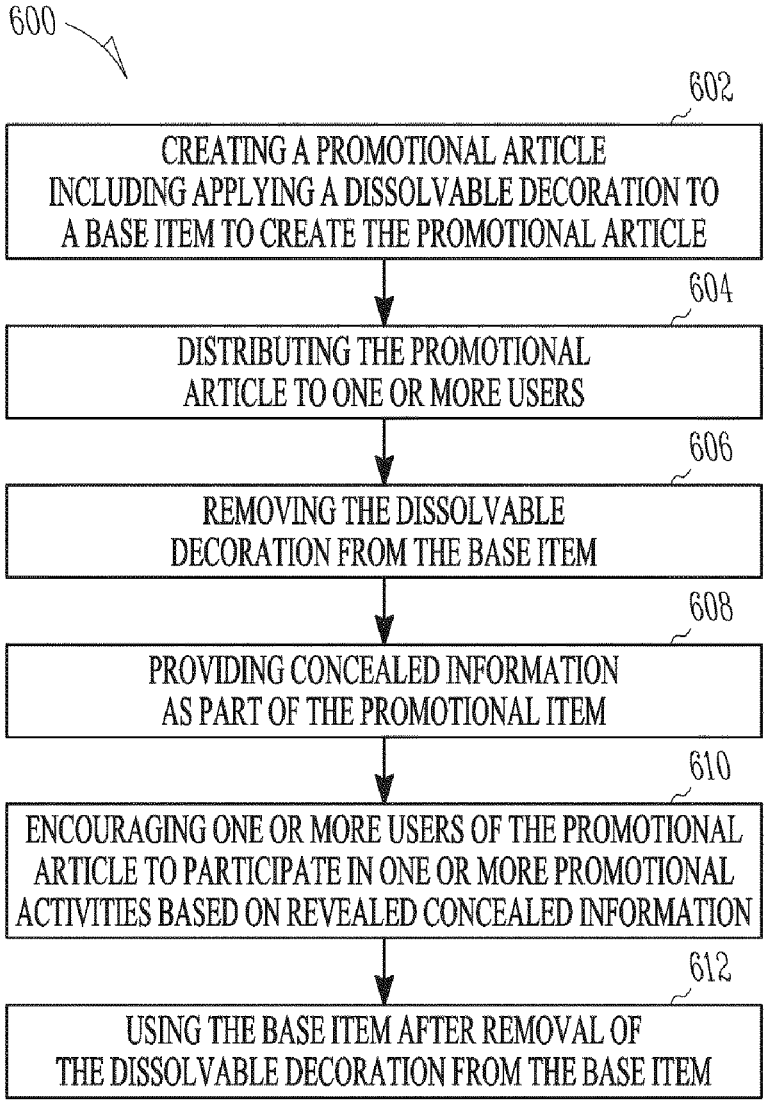
FIG. 6A is a flow chart illustrating several methods according to various embodiments.

FIG. 6A is a flow chart illustrating several methods according to various embodiments. No particular sequence is necessarily required based on the order of the flowchart in FIG. 6A. Embodiments of method 600 as illustrated in FIG. 6A do not necessarily require all of the blocks depicted in FIG. 6A.

In FIG. 6A, method 600 includes at block 602 creating a promotional article including applying a dissolvable decoration to a base item to create the promotional article. In various embodiments, the dissolvable decoration is applied in such a manner so as to be removable from the base item by dissolving the dissolvable decoration using a solvent without substantially altering an original physical condition of the base item. In various embodiments, the dissolvable decoration is a three-dimensional decoration formed by embedding a material in a dissolvable material.

In various embodiments, applying a dissolvable decoration includes the dissolvable decoration being water-soluble after being applied to the base item. In various embodiments, applying a dissolvable decoration includes forming the dissolvable decoration from a washable dye. In various embodiments, applying the dissolvable decoration includes forming the dissolvable decoration from a washable ink In various embodiments, applying the dissolvable decoration includes forming the dissolvable decoration from a soluble material. In various embodiments, applying the dissolvable decoration includes the dissolvable decoration being embroidery formed using a dissolvable thread. In various embodiments, applying a dissolvable decoration includes applying a dissolvable decoration including a removable decoration portion and a permanent decoration portion.

The method 600 at block 604 includes distributing the promotional article to one or more users. In various embodiments, distributing the promotional article includes the dissolvable decoration including a representation of subject matter that has a relevance to a particular time period sometime following or during which the promotion article is being distributed.

Method 600 at block 606 includes removing the dissolvable decoration from the base item. In various embodiments, removing the dissolvable decoration includes pre-treatment of the dissolvable decoration to make the dissolvable decoration dissolvable in a solvent. In various embodiments, removing the dissolvable decoration includes removing a dissolvable portion of the decoration, and not removing a permanent portion of the decoration.

Method 600 at block 608 includes providing concealed information as part of a promotional item. In various embodiment, removing the dissolvable decoration may include revealing one or more items of concealed information included on the base item and which are not visible until the dissolvable decoration is removed from the base item. In various embodiments, revealing one or more items of concealed information includes revealing information related to further promotional activities. In various embodiments, further promotional actives includes information related to claiming prizes. In various embodiments the concealed information includes entry codes or instructions for entry into contests involving promotional activities.

Method 600 at block 610 includes encouraging one or more users of the promotional article to participate in one or more promotional activities based on revealed concealed information. Encouraging one or more users of the promotional article to participate in one or more promotional activities can include the use of any mechanism to encourage one or more acts to further promote a product, a service, an activity, or an event. Method 600 at block 612 includes using the base item after removal of the dissolvable decoration from the base item.

Figure 6B:
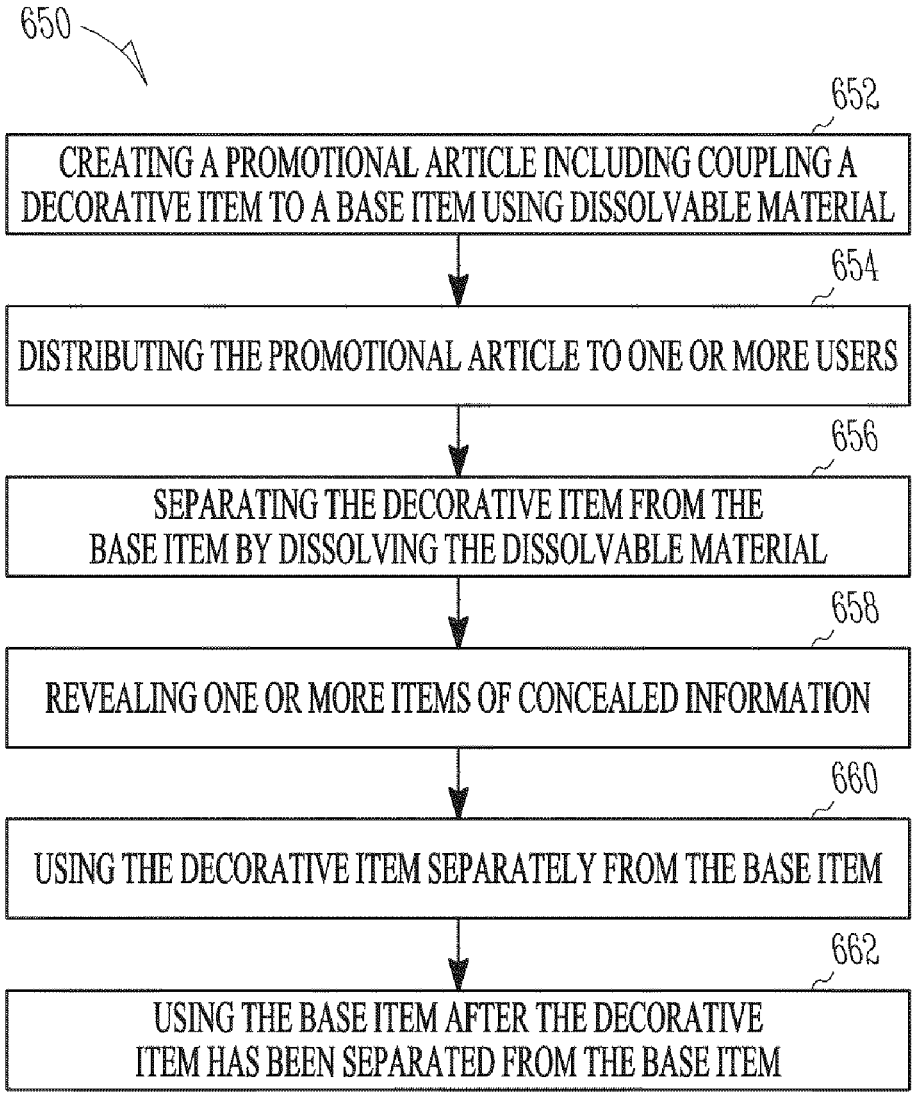
FIG. 6B is a flow chart illustrating several methods according to various embodiments.

FIG. 6B is a flow chart illustrating several methods according to various embodiments. No particular sequence is necessarily required based on the order of the flowchart in FIG.

6B. Embodiments of method 650 as illustrated in FIG. 6B do not necessarily require all of the blocks depicted in FIG. 6B.

In FIG. 6B, method 650 includes at block 652 creating a promotional article including coupling a decorative item to a base item using a dissolvable material. In various embodiments, coupling the decorative item to the base item includes coupling the decorative item to the base item so that the decorative item may be separated from the base item by dissolving the dissolvable material without substantially altering the original physical condition of the base item, and without substantially altering the original physical condition of the decorative item. In various embodiments, coupling a decorative item to a base item using a dissolvable material includes coupling the decorative item to the base item using dissolvable thread.

The method 650 at block 654 includes distributing the promotional article to one or more users. In various embodiments, distributing the promotional article includes distributing the promotional article including a decoration item including a representation of subject matter that has a relevance to a particular time period during which the promotion article is being distributed.

Method 650 at block 656 includes separating the decorative item from the base item by dissolving the dissolvable material. In various embodiments, separating the decorative item from the base item includes at block 658 revealing one or more items of concealed information. In various embodiments, revealing one or more items of concealed information includes revealing concealed information included on the base item. In various embodiments, revealing one or more items of concealed information includes revealing concealed information included on a concealed surface of the decorative item.

Method 650 at block 660 includes using the decorative item separately from the base item. In various embodiments, using the decorative item separately from the base items includes attaching the decorative item to an item other than the base item from which the decorative item was previously attached.

Method 650 at block 662 includes using the base item after the decorative item has been separated from the base item.

Various embodiments of articles and methods including temporary decorations applied to promotional articles are described herein. The application of a temporary decoration adds value for the person receiving the article because the decoration is of a temporary nature, while still providing the entity for which the promotional article has been created the benefit of the promotional aspects of the promotional article. As noted above, the promotional aspects of the promotional article may include, but are not limited to, promotion of any products or services provided by the entity, or events or promotional activities for which the promotional article has been created. By providing a temporary decoration on a base item, and allowing the user to later remove the temporary decoration from the base item, the base item may have more value to the user in that the user may be more likely to use the base item at a time other than a time period relevant to the promotional message provided by the decoration.

A temporary decoration may include an image that is associated with other items, such as a costume. For example, a child's Halloween costume may include a temporary decoration on a particular item of the costume, such as a top or a shirt, that is associated with another part of the costume, for example a mask. The temporary decoration may include images or other graphic depictions associated with the theme of the costume and other items included in the costume, such as the mask. After the costume is used, or at some later time, the temporary decoration may be removed, and the top or shirt may then continue to be worn for other occasions, including regular use for activities, events, or time periods not associated with the use for which the costume was intended. For example, the top or shirt could be used as school clothing. In this example, a higher quality base item could be used for the top or shirt, as opposed to the very inexpensive material often used for making children's Halloween costumes, and thereby provide more value to the user by including a high quality base item.

Because the decoration is temporary, the choice of a base item may include a higher quality base item, for example a higher quality item of clothing. The decision to use a higher quality base item may be prompted by the fact that the user is more likely to use the base item after the decoration has been removed, and thus would justify the possibly higher cost associated with the higher quality base item. The use of the higher quality base item avoids the problem associated with the user and other persons who may come in contact with the base item having a perception that the entity for which the promotional article was created is "cheap" or somehow is associated with low quality goods or services.

By allowing the decoration to be user removable, the user also can choose when to remove the decoration from the base item, and has the option to leave the decoration on the base item.

By the addition of concealed information, such as prize or contest information as described above, the entity for which the promotional article is created may instill the users receiving the promotional articles, or persons coming into contact with the promotional article, to act in additional ways that promote the entity's products, services, activities, or events. For example, where a code is revealed upon removal of the decoration, the code may prompt the user receiving the promotional article to go to the entity's place of business to see if the code represents a winning number associated with a prize. By attracting the user to the entity's place of business, or for example to use a particular web site associated with the entity for which the promotional article was created, further promoting of the entity's products, services, activities, and events may be achieved. Thus, the concealed information provides a mechanism to encourage one or more acts to further promote a product, a service, an activity, or an event.

The temporary decoration included as part of a promotional article may be of a nature so as to have a time limited value, such as an expiration date, that will encourage certain actions by the users, or other persons coming in contact with the promotional item, within a particular time period. For example, a discount may be offered through the promotional article on products or services, but only for a time period as depicted by the decoration, or as included in the concealed information incorporated into the promotional article. Thus, the user receiving the promotional article, or other persons coming in contact with the promotional item, are encouraged to take action within the particular time period, for example but not limited to the purchase of products or services within the time period.

In the foregoing specification, embodiments of the present invention have been described with reference to specific exemplary embodiments thereof. It will, however, be evident that various modifications and changes may be made to the specific exemplary embodiments without departing from the broader spirit and scope of the invention as set forth in the appended claims. Accordingly, the specification and drawings are to be regarded in an illustrative rather than a restrictive sense.

What is claimed is:

1. An article comprising:

a base item comprising a promotional article for distributing to promote products, services, activities, or events and intended to be worn by a person, wherein the base item comprises a permanent decoration having a first image of a logo, wherein the logo conveys first information;

a removable decorative item having a second image comprising a replica of the logo, wherein the replica conveys second information;

a material coupling the decorative item to the base item, wherein the material is dissolvable so that the decorative item may be separated from the base item without substantially altering the physical condition of the base item and without substantially altering an original physical condition of the decorative item, wherein the first image of the logo is revealed upon removal of the decorative item from the base item.

2. The article of claim 1, wherein the decorative item may be coupled to a second item after removing the decorative item from the base item, wherein the decorative item includes a cloth patch, and the material includes a dissolvable thread to couple the decorative item to the base item.

3. The article of claim 1, wherein once removed, the decorative item provides a voucher for an entry into a contest or event.

4. The article of claim 1, wherein the base item includes an article of children's clothing of relatively expensive material, wherein the decorative item is of relatively inexpensive material and includes subject matter associated with a relatively inexpensive costume, and wherein the base item may be worn for occasions not associated with the use for which the costume was intended, when the decorative item is separated from the base item.

5. The article of claim 1, wherein the base item includes a baseball hat.

6. The article of claim 1, wherein the base item includes one or more types of concealed information that are concealed by the decorative item, the concealed information being exposed upon a removal of the decorative item, and wherein the one or more types of concealed information providing a mechanism to encourage one or more acts to further promote a product, a service, an activity, or an event.

7. The article of claim 6, wherein the concealed information comprises a code used as an entry into a promotional event.

8. The article of claim 6, wherein the decorative item possesses an image and color, and wherein the replica has a color different from that of the decorative item.

9. The article of claim 6, wherein the decorative item comprises a modern version of a trademark, and wherein the concealed information comprises a historical version of the trademark.

10. The article of claim 1, wherein the material is dissolvable when exposed to a solution including water and soap.

11. The article of claim 1, wherein the promotional article has a relatively higher cost than the decorative item, and wherein a person is more likely to wear the article after the decorative item has been removed than if the decorative item were not removed.

12. The article of claim 1, wherein the logo comprises a bar code readable by a scanner for entry into a promotional event.

13. The article of claim 1, wherein the base item comprises a promotional item of clothing, wherein the logo represents a trademark, and wherein the replica represents a historical version of the trademark.

14. The article of claim 1, wherein the base item comprises a baseball hat, wherein the logo represents a trademark used by a sports team, and wherein the replica represents a historical version of the trademark.

15. The article of claim 1, wherein the base item includes a promotional item of clothing.

16. The article of claim 1, wherein the logo comprises a machine-readable graphical representation.

* * * * *

UNITED STATES PATENT AND TRADEMARK OFFICE

CERTIFICATE OF CORRECTION

PATENT NO. : 8,037,545 B2
APPLICATION NO. : 11/724974
DATED : October 18, 2011
INVENTOR(S) : Gerald McLaughlin It is certified that error appears in the above-identified patent and that said Letters Patent is hereby corrected as shown below:

On the Title Pg, Item (56), under "Other Publications", line 1, delete "Aplication" and insert -- Application --, therefor.

On the Title Pg, Item (56), under "Other Publications", line 3, delete "Aplication" and insert -- Application --, therefor.

In column 9, line 1, delete "item," and insert -- item. --, therefor.

In column 12, line 17, delete "ink" and insert -- ink. --, therefor.

In column 12, line 51, delete "actives" and insert -- activities --, therefor.

In column 15, line 18, in Claim 1, delete "item," and insert -- item; --, therefor.

In column 15, line 20, in Claim 1, delete "item." and insert -- item; wherein the decorative item includes a cloth patch, and the material includes a dissolvable thread to couple the decorative item to the base item. --, therefor.

In column 15, lines 23-25, in Claim 2, delete "item, wherein the decorative item includes a cloth patch, and the material includes a dissolvable thread to couple the decorative item to the base item." and insert -- item. --, therefor.

Signed and Sealed this
Tenth Day of January, 2012

David J. Kappos

David J. Kappos
*Director of the United States Patent and Trademark Office*